United States Patent [19]

Lin

[11] Patent Number: 4,850,587

[45] Date of Patent: Jul. 25, 1989

[54] DUAL EXERCISE BICYCLE

[76] Inventor: Pads Lin, 2-1, Nan Pei 1st Rd., Tachia Town, Taichung Hsien, Taiwan

[21] Appl. No.: 284,550

[22] Filed: Dec. 15, 1988

[51] Int. Cl.[4] ..... A63B 21/00; A63B 69/06

[52] U.S. Cl. ..... 272/72; 272/73; 272/120

[58] Field of Search ..... 272/72, 73, 120, 116, 272/125, 126, 121, 128, 144, 85, 86, 134, 142

[56] References Cited

U.S. PATENT DOCUMENTS

| | | | |
|---|---|---|---|
| 459,282 | 8/1891 | Gollon | 272/120 |
| 4,300,760 | 11/1981 | Bobroff | 272/120 |
| 4,468,025 | 8/1984 | Sterle | 272/72 |
| 4,743,010 | 5/1988 | Geraci | 272/72 |

*Primary Examiner*—S. R. Crow

*Attorney, Agent, or Firm*—Mason, Fenwick & Lawrence

[57] ABSTRACT

A dual exercise device includes a frame having an elongated seat bar and a vertical support at the front end of the seat bar. Struts intersect and are connected pivotally to the seat bar near the seat of the bar. The struts have an upper back supporting portion and a lower leg portion with a wheeled bottom end. The back supporting portion moves rearward when the upper body of the user inclines rearward so that the lower leg portion moves forward against an extension spring provided between the leg portion and the rear end of the seat bar. A steel rope extends along the seat bar and has a portion extending upward from the front side of the frame and another portion extending and being fixed to the wheeled bottom end from the rear side of the frame. The upward portion is provided with a handle rod to be pulled by the user. A bicycle wheel associated with a pair of paddles is mounted on the front support.

6 Claims, 4 Drawing Sheets

DUAL EXERCISE BICYCLE

BACKGROUND OF THE INVENTION

This invention relates to an exercise device, and particularly to a dual exercise device which includes a frame associated with a bicycle wheel incorporating a pair of paddles, strut members which have a back supporting portion and a rear leg portion and which are pivoted to the frame, and a pull rod having a handle and extending along the frame and having a portion extending upward from the front side of the frame to be pulled by the user and another portion extending to the leg portion from the rear side of the frame and fixed thereat.

An object of the invention is to provide a dual exercise device which can be used as an exercise bicycle as well as a sit-up exercise device.

According to the present invention, an exercise device comprises a frame including a seat bar which has a front end and a rear end, and a vertical front support at the front end, the frame having a substantially flat elongated top side; a seat mounted on the seat bar between the front end and the rear end; a stationary base connected pivotally to the front support, the front support being movable forward and backward relative to the stationary base; a rear strut means intersecting with and being connected pivotally to the seat frame near the seat, the strut means having a leg portion below the seat frame and a back supporting portion above the seat frame, the leg portion having a wheeled bottom end; an extension spring having a first end affixed to the seat frame adjacent to the rear end of the seat frame and a second end affixed to the leg portion so as to urge the leg portion to incline rearward; and a pull rope associated with the frame, having a portion extending upward from the top side of the frame near the front end of the seat bar, the first portion having an end with a pull handle rod, the pull rope further extending along the seat bar from the upward portion toward the rear end of the seat bar, then to the wheeled bottom end from the rear end; and guide rollers attached to the frame for allowing the pull rope to turn by passing thereover.

In one aspect of the invention, the stationary base has a U-shaped cross-section and includes two spaced apart side plates and a bottom plate interconnecting the side plates. The front support is a vertical flat housing member which includes two side panels connected pivotally to the side plates of the stationary base, and a front plate, a top plate and a rear plate all of which interconnect the side panels.

In another aspect of the invention, the device further comprises a bicycle wheel and a shaft provided in the housing member and mounted on the side panels, two crank members outside the housing member and connected to the shaft, and two paddles respectively connected to the crank members.

In still another aspect of the invention, the wheeled bottom end of the strut means includes a horizontal transverse axle connected to the leg portion, and two rollers connected to the axle.

The exemplary preferred embodiment will be described in detail with reference to the accompanying drawings, in which;

DETAILED DESCRIPTION OF THE PREFERRED EMBODIMENT

Figure 1:
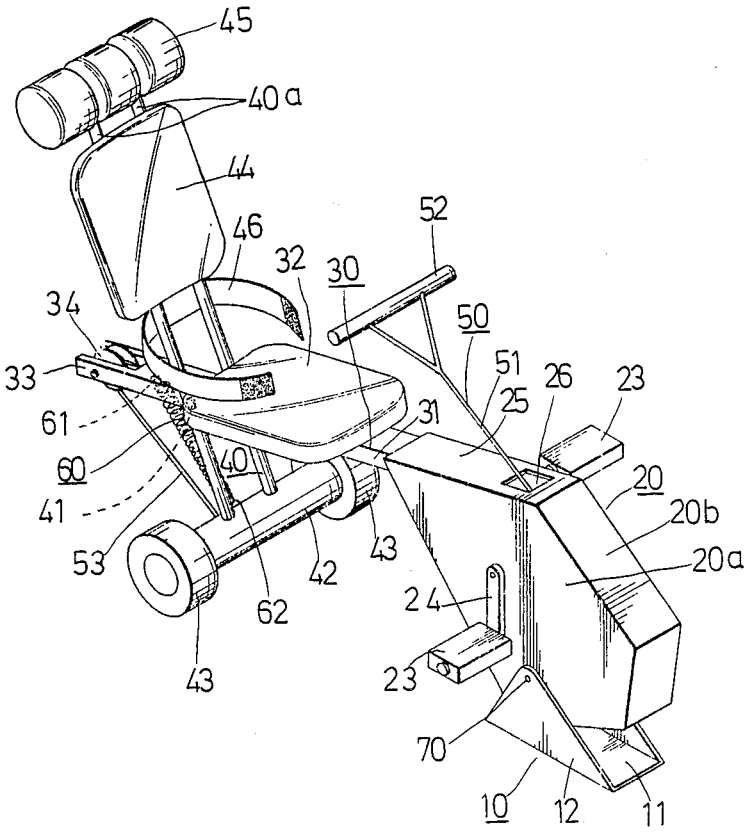
FIG. 1, is a perspective view of an exercise device according to the present invention.
Figure 2:
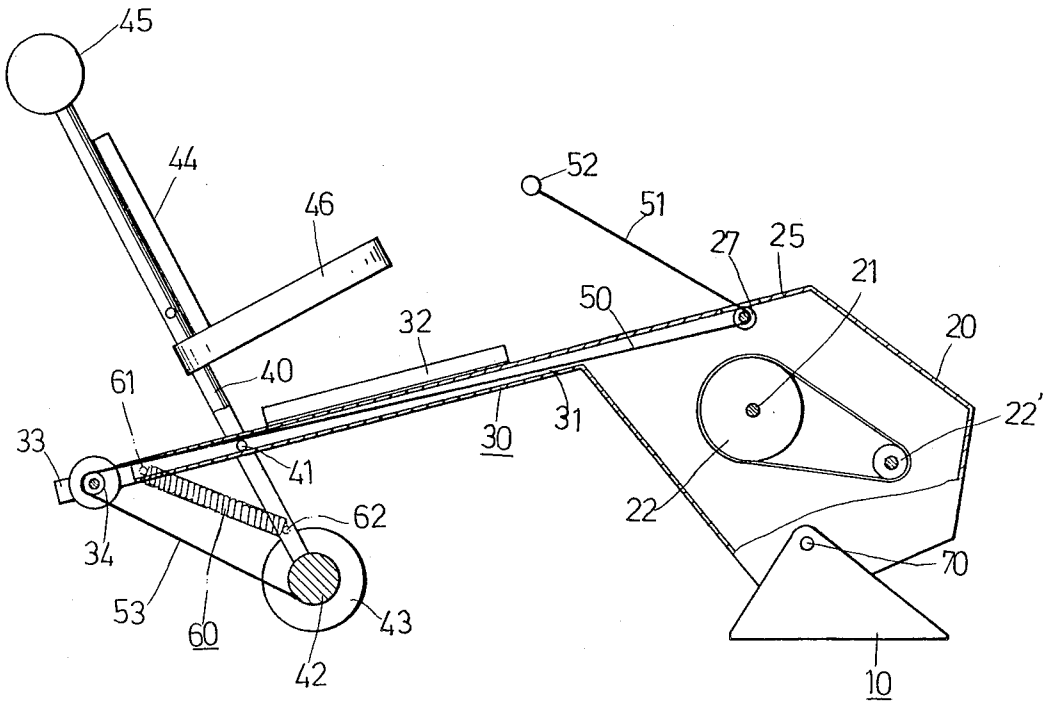
FIG. 2 is a side elevation view of the exercise device of FIG. 1.
Figure 3:
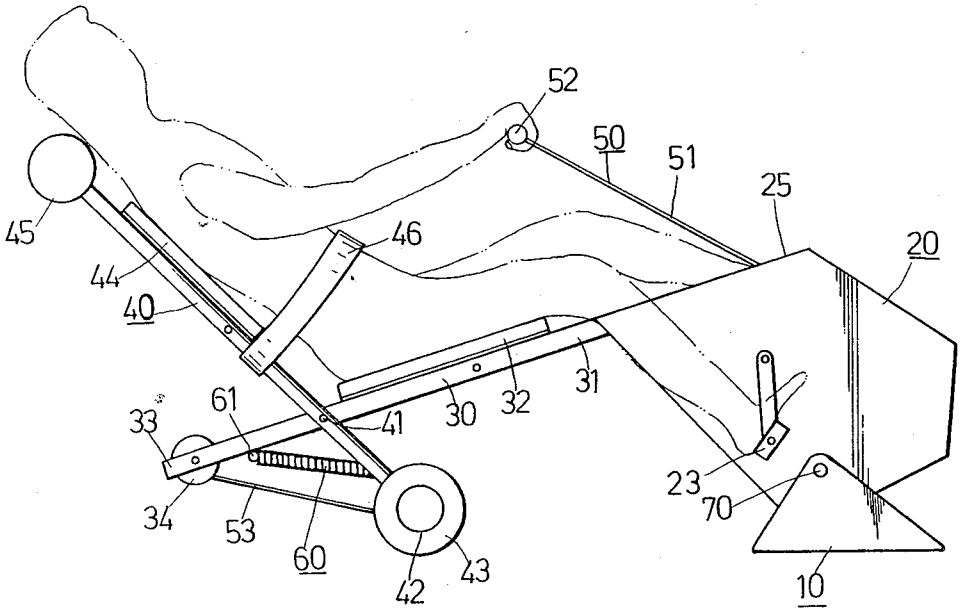
FIGS. 3 & 4 show how the user manipulates the exercise device.
Figure 4:
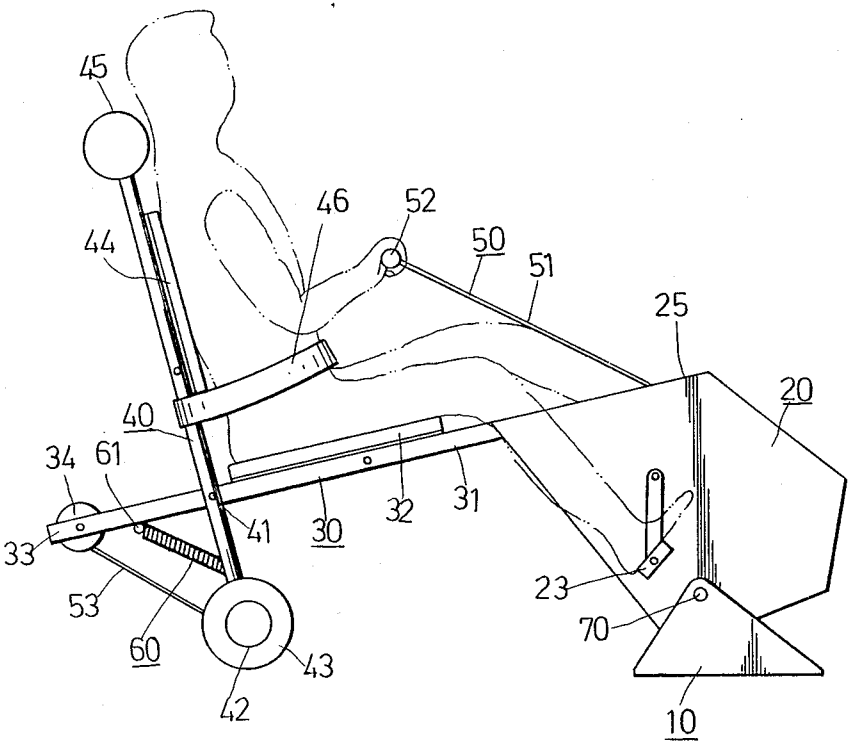

Referring to FIGS. 1,2, 3 and 4, an exercise device is shown, including a stationary base 10, a front support 20, a seat bar 30, a rear support 40, a pull rope 50, and an extension spring 60.

The cross section of the stationary base 10 is U-shaped. The stationary base 10 has two spaced apart triangular side plates 12 and a base plate 11 interconnecting the side plates 12. The front support 20 is a housing member which has two spaced apart side panels 20*a* whose bottom portions are pivoted to the side plates 12 at 70 so that the front support 2 can move forward and rearward relative to the stationary base 10. The side panels 20*a* are interconnected by a front plate 20*b*, a top plate 25 and a rear plate (not shown). A wheel 22 is provided in the housing 20 and is mounted rotatably on the panels 20*a* through a shaft 21 whose ends extend outward from the housing 20 and respectively carry two cranks 24 which in turn hold two paddles 23. The wheel 22 is connected to a further wheel 22' through a transmission chain. The top plate 25 is provided with an aperture 26. A roller 27 is mounted on the side panels 20*a* adjacent to the aperture 26.

The seat bar 30 is a hollow bar whose front end is connected rigidly by being welded to the top plate 25 of the support 20. The seat bar 30 extends substantially horizontally at the same level as the top plate 25. A seat 32 is mounted on the seat bar 30. A roller 34 is mounted on the forked end 33 of the seat frame 30.

The rear support 40 includes two struts 40*a* which intersect the seat bar and are pivoted to the seat bar 30 at 41 near the seat 32. The struts 40*a* form a leg portion below the seat bar 30 and a back supporting portion above the seat bar 30. A back 44 and a head cushion 45 are mounted on the back supporting portion. A protective belt 46 is attached to the back supporting portion near the back 44. An axle 42 which carries two wheels 43 is connected to the bottom ends of the leg portion of the support 40. A protective belt 46 is fixed to the back supporting portion.

The pull rope 50 is made of steel and has a portion 51 which extends upward from an aperture 26 of the top plate 25. The pull rope 50 passes over the roller 27 near the aperture 26, extends in the seat bar 30 to the rear roller 34, and the portion 53 thereof extends to the axle 42 passing over the roller 34. The end of the rope 50 is affixed to the axle 42. The spring 60 has one end 61 fixed to the rear portion of the seat bar 30. The other end of the seat bar is fixed to the leg portion of the support 40.

The exercise device of the present invention can be operated either as an exercise bicycle or a sit-up exercise apparatus. When the apparatus is used as the exercise bicycle, the user may put his feet on the paddle 23, incline his upper body rearward, and hold the handle rod 52. Since the back supporting portion of the support 40 moves rearward, the leg portion moves forward, thereby causing the steel rope 51 to tense. In this situation, the steel rope and the handle rod serve as a rigid handle.

In case the exercise device is used as a sit-up apparatus, the user may put his feet on the paddle 23 and hold the handle rod 52. When the user sits and pulls the handle 52 rearward, the rope 51 pulls the axle 42 rearward, thereby causing the back 44 to move forward. In this position, the user is in a sitting position. When the user removes the pulling force, the rollers 43 move forward, thereby causing the back 44 to move rearward to the position in which the user inclines his upper body rearward (see FIG. 3).

With the invention thus explained, it is apparent that various modifications and variations can be made without departing from the scope of the invention. It is therefore intended that the invention be limited only as indicated in the appended claims.

What I claim is:

1. An exercise device comprising:

a frame including a substantially horizontal seat bar which has a front end and a rear end, and a vertical front support at said front end; having a pair of paddles mounted thereon a seat mounted on said seat bar between said front end and said rear end;

a stationary base provided below and connected pivotally to said front support, said front support being movable forward and backward relative to said stationary base;

a rear strut means intersecting and being connected pivotally to said seat bar near said seat, said strut means having a leg portion below said seat bar and a back supporting portion above said seat bar, said leg portion having a Wheeled bottom end;

an extension spring having a first end affixed to said seat bar adjacent to said rear end of said seat bar and a second end affixed to said leg portion so as to urge said leg portion to move rearward; and a pull rope associated with said seat bar, the pull rope having a portion extending upward from the top of said frame near said front end of said seat bar, said portion of said pull rope having an end provided with a pull handle rod, said pull rope further extending along said seat bar from said front end toward said rear end of said seat bar, then to said wheeled bottom end from said rear end of said seat bar, said pull rope being fixed to said wheeled bottom end; and guide rollers attached to said frame for guiding said pull rope thereover; whereby a user supports his feet on said paddles and pulls said handle rod thereby causing pivotal movement of said strut means relative to said seat bar.

2. An exercise device as claimed in claim 1, wherein said stationary base has a U-shaped cross-section and includes two spaced apart side plates and a bottom plate interconnecting said side plates.

3. An exercise device as claimed in claim 1, wherein said front support is a vertical flat housing member which includes two side panels connected pivotally to said side plates of said stationary base, and a front plate, a top plate and a rear plate all of which interconnect said side panels.

4. An exercise device as claimed in claim 3, further comprising a bicycle wheel and a shaft provided in said housing member and mounted on said side panels, two crank members outside said housing member and connected to said shaft, and said two paddles respectively connected to said crank members.

5. An exercise device as claimed in claim 1, wherein said wheeled bottom end of said strut means includes a horizontal axle connected to said leg portion, and two rollers connected to said axle.

6. An exercise device as claimed in claim 1, wherein said seat bar is a hollow bar.

* * * * *